US007866370B2

(12) United States Patent
Cunha

(10) Patent No.: US 7,866,370 B2
(45) Date of Patent: Jan. 11, 2011

(54) BLADES, CASTING CORES, AND METHODS

(75) Inventor: Francisco J. Cunha, Avon, CT (US)

(73) Assignee: United Technologies Corporation, Hartford, CT (US)

( * ) Notice: Subject to any disclaimer, the term of this patent is extended or adjusted under 35 U.S.C. 154(b) by 945 days.

(21) Appl. No.: 11/699,610

(22) Filed: Jan. 30, 2007

(65) Prior Publication Data

US 2008/0181774 A1 Jul. 31, 2008

(51) Int. Cl.
*B22C 9/04* (2006.01)
*B22C 9/10* (2006.01)

(52) U.S. Cl. ..... 164/369; 164/516

(58) Field of Classification Search ..... 164/369, 164/35, 516–519
See application file for complete search history.

(56) References Cited

U.S. PATENT DOCUMENTS

| | | | | |
|---|---|---|---|---|
| 6,824,359 | B2 | 11/2004 | Chlus et al. | |
| 6,951,239 | B1 | 10/2005 | Snyder et al. | |
| 6,974,308 | B2 | 12/2005 | Halfmann et al. | |
| 7,014,424 | B2 | 3/2006 | Cunha et al. | |
| 7,059,834 | B2 | 6/2006 | Chlus et al. | |
| 7,270,170 | B2 | 9/2007 | Beals et al. | |
| 7,413,403 | B2 * | 8/2008 | Cunha et al. | 416/1 |
| 2003/0075300 | A1 * | 4/2003 | Shah et al. | 164/369 |
| 2004/0020629 | A1 | 2/2004 | Shah et al. | |
| 2005/0133193 | A1 * | 6/2005 | Beals et al. | 164/516 |
| 2007/0147997 | A1 | 6/2007 | Cunha et al. | |

FOREIGN PATENT DOCUMENTS

| | | |
|---|---|---|
| EP | 1306147 A | 5/2003 |
| EP | 1543896 A | 6/2005 |
| EP | 1634665 A2 | 3/2006 |

OTHER PUBLICATIONS

European Office Action for EP08250311.1, dated Nov. 2, 2009.

* cited by examiner

*Primary Examiner*—Kuang Lin
(74) *Attorney, Agent, or Firm*—Bachman & LaPointe, P.C.

(57) ABSTRACT

An article includes a blade casting core combination. The combination includes a ceramic feedcore and a metallic core. The ceramic feedcore has: a root end; a tip end; a leading end; a trailing end; a first side; a second side; and a plurality of legs extending between the root and tip ends and arrayed between the leading and trailing ends. The metallic core has: a first face; a second face; a first portion extending from the feedcore trailing end; and a second portion extending from the tip end. The article may be a pattern where the core is embedded in a wax or may be a shell formed from such a pattern. The article may be used in a method for forming the resultant blade.

9 Claims, 7 Drawing Sheets

BLADES, CASTING CORES, AND METHODS

BACKGROUND OF THE INVENTION

The invention relates to gas turbine engines. More particularly, the invention relates to the casting of gas turbine engine blades.

Heat management is an important consideration in the engineering and manufacture of turbine engine blades. Blades are commonly formed with a cooling passageway network. A typical network receives cooling air through the blade platform. The cooling air is passed through convoluted paths through the airfoil, with at least a portion exiting the blade through apertures in the airfoil. These apertures may include holes (e.g., "film holes") distributed along the pressure and suction side surfaces of the airfoil and holes at junctions of those surfaces at leading and trailing edges. Additional apertures may be located at the blade tip. In common manufacturing techniques, a principal portion of the blade is formed by a casting and machining process. During the casting process a sacrificial core is utilized to form at least main portions of the cooling passageway network.

In turbine engine blades (especially high pressure turbine (HPT) section blades), thermal fatigue of tip region of a blade airfoil is one area of particular concern. U.S. Pat. No. 6,824,359 discloses cooling air outlet passageways fanned along a trailing tip region of the airfoil. U.S. Pat. No. 7,059,834 discloses direction of air through a relief in a wall of a tip pocket to cool a trailing tip portion. U.S. patent application Ser. No. 11/317,394 discloses use of a tip flag passageway to deliver a high volume of cooling air to a trailing tip portion.

SUMMARY OF THE INVENTION

The article may be a pattern where the core is embedded in a wax or may be a shell formed from such a pattern. The pattern may comprise a wax body over portions of the metallic core and feedcore and may include portions corresponding to the ultimate casting (e.g., a platform portion; an airfoil portion having leading and trailing edges, pressure and suction sides, a tip and a proximal end at the platform; and a root portion depending from the platform portion opposite the airfoil portion). The metallic core first portion may include a main portion embedded in the wax body and a perimeter portion protruding from the wax body at the airfoil trailing edge. The metallic core second portion may include a main portion embedded in the wax body and a perimeter portion protruding from the wax body at the airfoil tip. The shell may be over portions of the metallic core and feedcore and may have a cavity generally corresponding to the shape of the article to be cast (e.g., a platform portion; an airfoil portion having leading and trailing edges, pressure and suction sides, a tip and a proximal end at the platform; and a root portion depending from the platform portion opposite the airfoil portion). The metallic core first portion may include a main portion exposed within the cavity and a perimeter portion embedded in the shell at the airfoil trailing edge. The metallic core second portion may include a main portion exposed within the cavity and a perimeter portion embedded in the shell at the airfoil tip. The article may be used in a method for forming the resultant blade. In the method, the ceramic feedcore may be molded. A metallic sheet may be cut to form the RMC. The RMC may be secured to the feedcore. The sacrificial pattern material (wax) may be molded at least partially over the assembled feedcore and RMC to form the pattern. The pattern may be shelled to form a shell. The wax may be removed from the shell. Metal may be cast in the shell. The shell and assembled feedcore and RMC may be removed from the cast metal. The removal of the metallic core may leave a trailing edge outlet passageway and a tip outlet passageway. The securing may embed a portion of the RMC in slots in trailing and tip portions of the feedcore. The shelling may embed portions of the RMC in the slots and the trailing tip portions of the shell. The removing may leave a plurality of posts in the trailing edge outlet passageway and the tip outlet passageway.

The article may be a pattern where the core is embedded in a wax or may be a shell formed from such a pattern. The article may be used in a method for forming the resultant blade.

Another aspect of the disclosure involves a blade which may be cast from the article. The blade has: a platform; an airfoil; and a root. The airfoil has: a leading edge; trailing edge; a pressure side; a suction side; a tip; and a proximal end at the platform. The root depends from the platform opposite the airfoil. The blade has a plurality of feed passageways. An outlet slot extends from the feed passageways to the trailing edge and tip.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
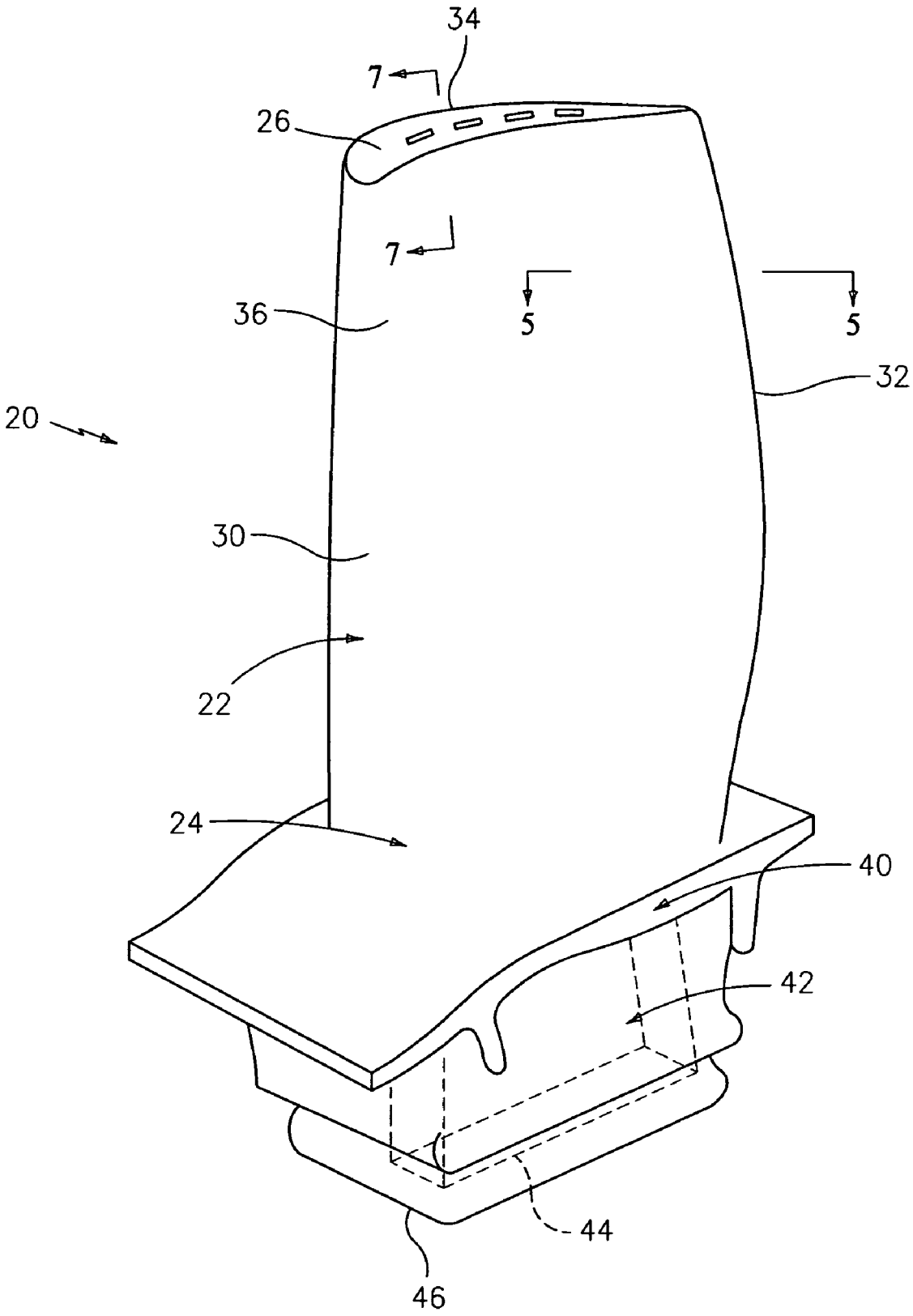
FIG. 1 is a view of a gas turbine engine blade.

FIG. 1 shows a blade 20 (e.g., an HPT blade) having an airfoil 22 extending along a span from an inboard end 24 to an outboard tip 26. The blade has leading and trailing edges 30 and 32 and pressure and suction sides 34 and 36.

A platform 40 is formed at the inboard end 24 of the airfoil and locally forms an inboard extreme of a core flowpath through the engine. A convoluted so-called "fir tree" attachment root 42 depends from the underside of the platform 40 for attaching the blade to a separate disk. One or more ports 44 may be formed in an inboard end of the root 42 for admitting cooling air to the blade. The cooling air may pass through a passageway system 46 and exit through a number of outlets (described below) along the airfoil. As so far described, the blade 40 may be representative of many existing or yet-developed blade configurations. Additionally, the principles discussed below may be applied to other blade configurations.

Figure 2:
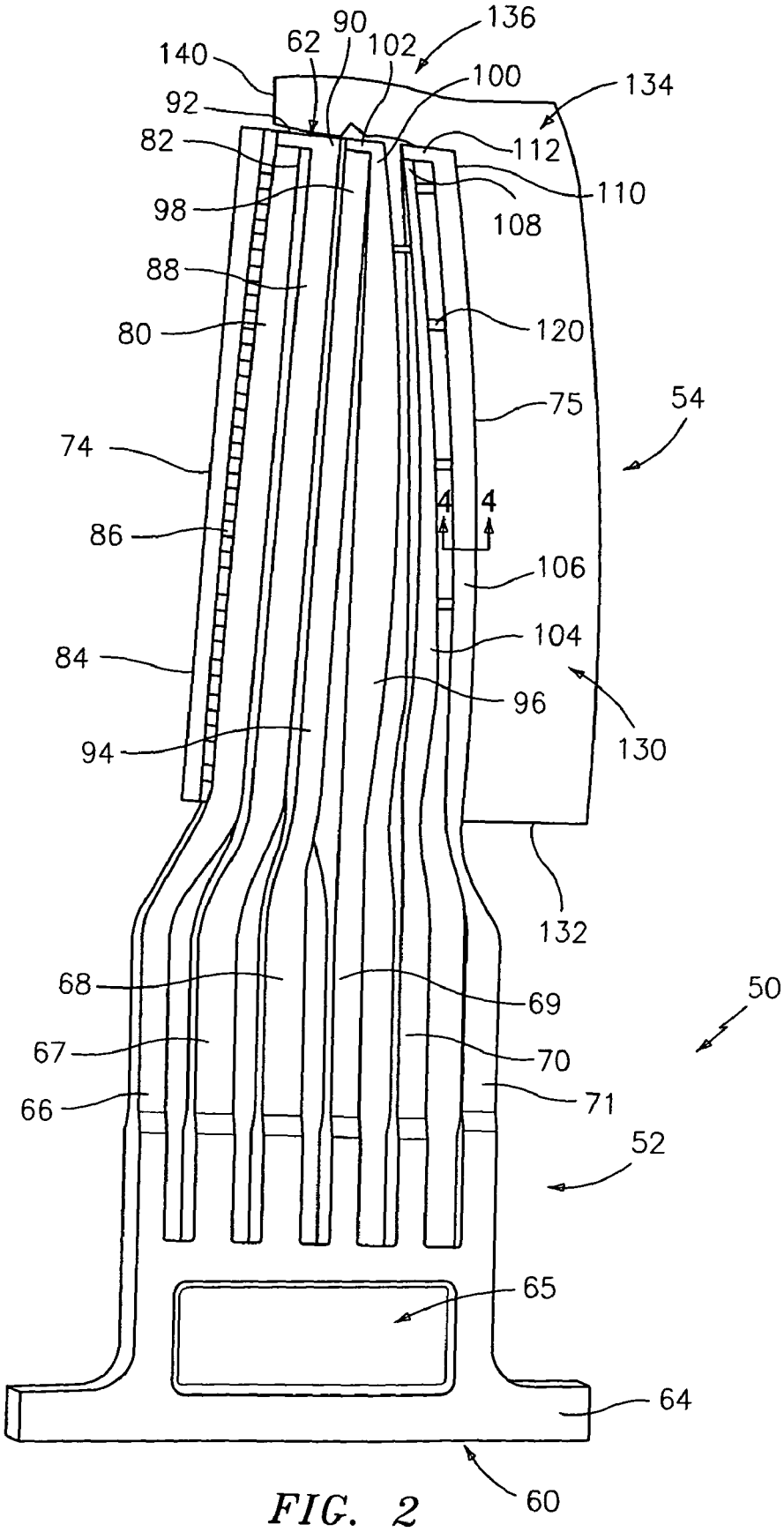
FIG. 2 is a first side view of a core assembly according to principles of the invention.

FIG. 2 shows an exemplary core assembly 50 for forming the passageway system. The assembly includes a feedcore 52 used to cast major portions of the passageway system. The assembly further includes a refractory metal core (RMC) 54 (e.g., comprising a substrate comprising at least 50% by weight of one or more refractory metals). The feedcore 52 may be formed of one or more molded ceramic pieces assembled to each other or to additional components such as refractory metal cores. For ease of reference, core directions are identified relative to associated directions of the resulting blade cast using the core. Similarly, core portions may be identified with names corresponding to associated passageway portions formed when those core portions are removed from a casting. Additional passageway portions may be drilled or otherwise machined.

Figures 3, 4:
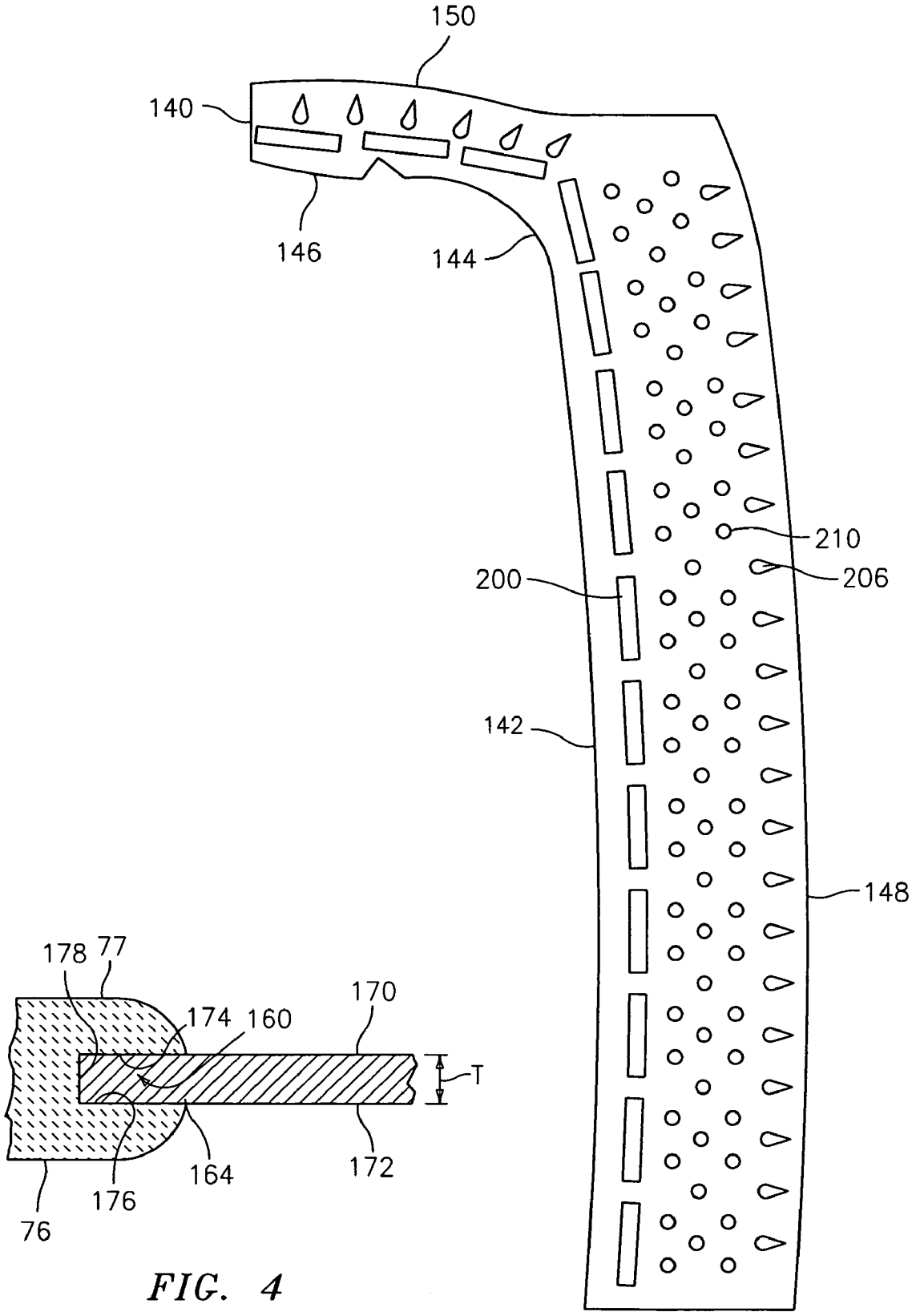
FIG. 3 is a first side view of a refractory metal core (RMC) of the assembly of FIG. 2.
FIG. 4 is a partial sectional view of the assembly of FIG. 2 taken along line 4-4.

The feedcore 50 extends from an inboard end 60 to an outboard/tip end 62. A base 64 is formed at the inboard end, with a port/plenum section 65 outboard thereof. From upstream to downstream, six trunks 66, 67, 68, 69, 70, and 71 extend tipward from the port/plenum section 65. The feedcore 50 also has a leading end or edge 74, a trailing end or edge 75, a suction side 76 (FIG. 4), and a pressure side 77 (FIG. 4). The trunks extend within the root 42 of the resulting blade 20 and form associated passageway trunks. The base 64 typically becomes embedded in a casting shell and falls outside the root 42.

In the exemplary feedcore 50, the leading trunk 66 joins a first spanwise feed passageway portion (leg) 80 extending to a tip/distal/outboard end 82. The exemplary feed passageway portion 80 is connected to a leading edge impingement chamber/cavity portion 84. The exemplary portion 84 is segmented. The cavity cast by the portion 84 may be impingement fed by airflow from the feed passageway cast by the leg 80, the air passing through a series of apertures cast by connecting posts 86. The airflow may cool a leading edge portion of the airfoil via exiting the impingement cavity through drilled or cast outlet holes.

The second trunk 67 joins a spanwise feed passageway portion (leg) 88 having a tip/distal/outboard end 90 joined to the first leg tip end 82 by a streamwise extending portion 92. In a similar fashion, the third and fourth trunks 68 and 69 respectively join spanwise feed passageway portions (legs) 94 and 96 having tip ends 98 and 100 joined by a streamwise extending portion 102. In similar fashion, the fifth and sixth trunks 70 and 71 respectively join spanwise feed passageway portions (legs) 104 and 106 having tip ends 108 and 110 joined by a streamwise extending portion 112.

Various adjacent spanwise legs may be joined at one or more intermediate locations by connectors 120. The connectors 120 may enhance core rigidity and may cast corresponding holes through walls between adjacent passageway legs of the casting.

The RMC 54 is generally L-shaped in planform having a leg portion 130 extending from an inboard first end 132 to a junction 134 with an outboard foot portion 136. The foot portion 136 extends to a leading end 140. The leg portion has a leading edge 142 extending outboard from the end 132 to an edge region 144 along the junction 134 and merging with an inboard edge 146 of the foot. The leg portion has a trailing edge 148 extending to the junction 134 where it joins an outboard edge 150 of the foot portion which forms an outboard end of the RMC 54.

A slot 160 (FIG. 4) is formed in the leg 106 along the trailing edge 75 of the feedcore and along the feedcore tip end 62 across the spanwise portions 92, 102, and 112. The slot 160 receives an adjacent portion 164 of the RMC (a leading portion along the edge 142 and an inboard portion along the edge 146). FIG. 4 shows the RMC as having first and second faces 170 and 172 received abutting associated slot faces 174 and 176, with a slot base 178 abutting the adjacent RMC edge 142, 140, 146. FIG. 4 further shows the RMC 54 as having an essentially constant thickness T between the faces 170 and 172. The slot height between the faces 174 and 176 may be the same or slightly greater and may accommodate an adhesive and/or other gap filler (e.g., a ceramic adhesive).

Figure 5:
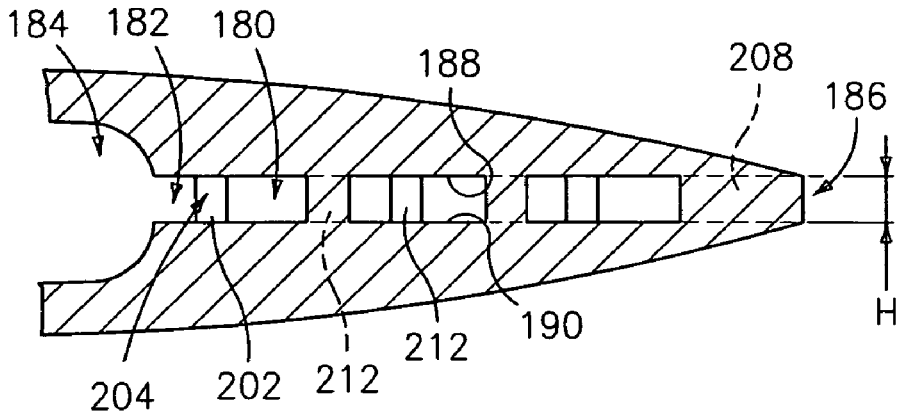
FIG. 5 is a partial sectional view of the blade of FIG. 1 taken along line 5-5.
Figure 6:
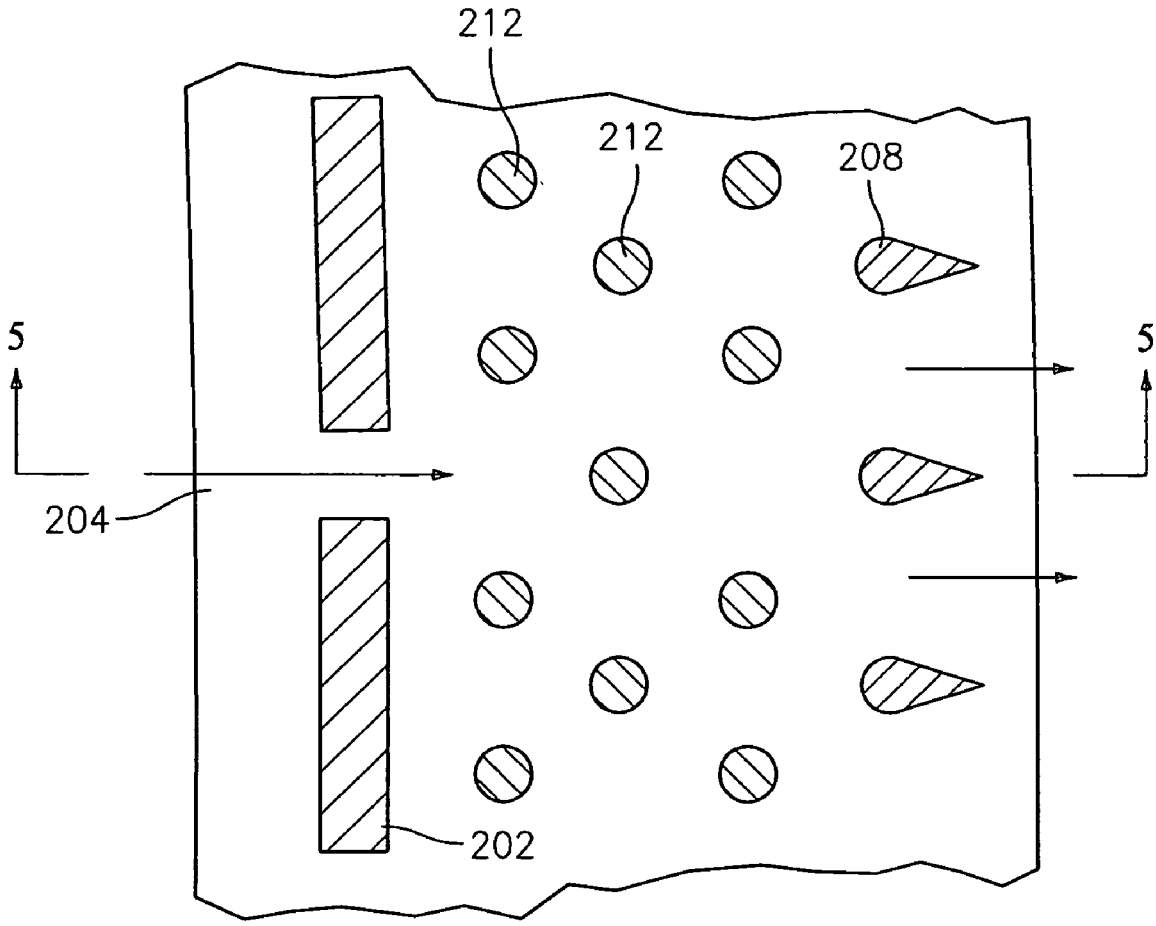
FIG. 6 is a slot-wise sectional view of an outlet slot of the blade of FIG. 1 along the trailing edge.

The RMC leg and foot portions cast respective trailing edge and tip portions of an outlet slot 180 (FIG. 5) for discharging cooling air delivered through the feed passageways cast by the feedcore. The slot 180 has an upstream inlet 182 at a trailing feed passageway leg 184 cast by the feedcore leg 106. The slot 180 extends downstream to an outlet 186 at the blade trailing edge. The slot has opposite side surfaces 188 and 190 separated by a height H. Exemplary H is essentially the same as the RMC thickness T. Along the RMC leg and foot portions, the RMC has a plurality of through-apertures for casting walls or posts in the slot. The exemplary RMC apertures include a leading group of apertures 200 (FIG. 3). The apertures 200 arrayed parallel to the edge portions 142, 144, 146. The apertures 200 are elongate in the direction of their array and are spaced relatively closely so as to cast a segmented wall 202 (FIGS. 5 and 6) with gaps 204 for metering an outlet flow. The apertures also include an array of streamwise elongate and tapering apertures 206 near the trailing edge 148 to define outlet walls 208. Intermediate groups of apertures 210 may cast posts 212.

Figure 7:
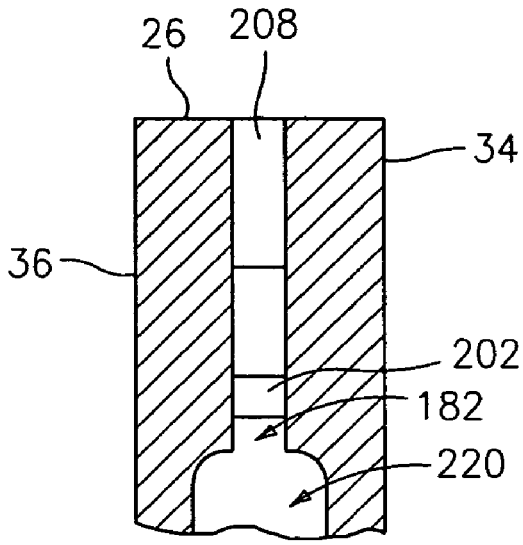
FIG. 7 is a partial sectional view of the blade of FIG. 1 taken along line 7-7.
Figure 8:
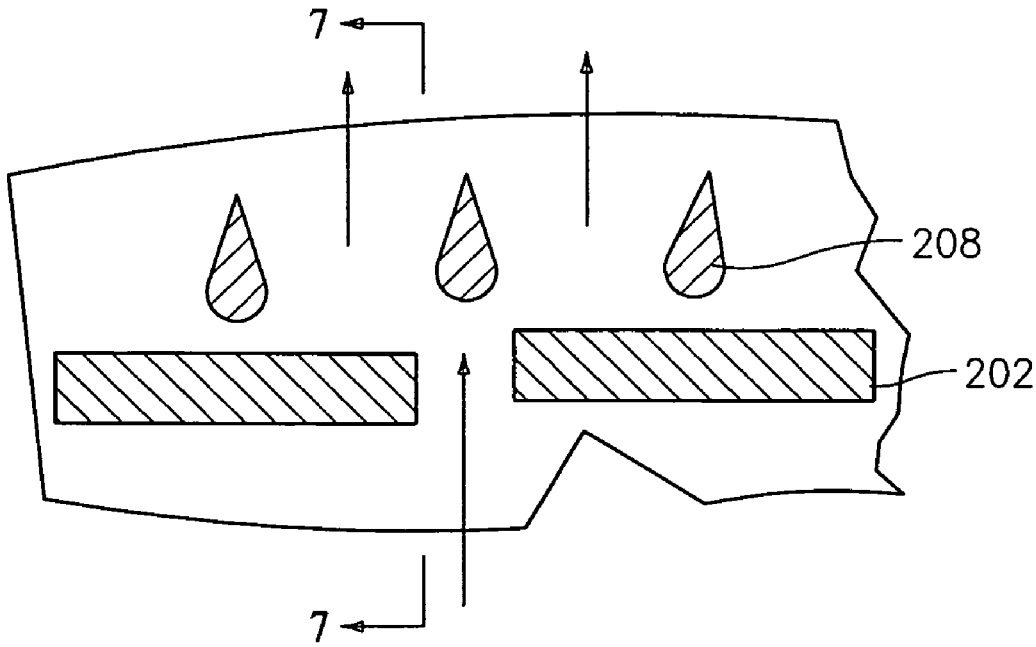
FIG. 8 is a slot-wise sectional view of the outlet slot of the blade of FIG. 1 along the tip.

Adjacent the outboard edge 150, the exemplary RMC includes the apertures 200 and 206, but not the intermediate apertures 210. However, other configurations are possible. FIG. 7 shows the walls or posts 202 and 208 cast by these apertures along the tip portion of the slot. The RMC apertures and resulting walls and posts may form a continuous array across the leg and foot portions of the RMC and associated trailing edge and tip portions of the slot. In particular, the orientation of the apertures 206 and posts/walls 208 may continuously fan across the transition at the trailing tip corner. FIG. 7 shows the wall 202 and post/walls 208 along the tip. Along the tip portion of the slot, the slot inlet 182 is at an exemplary feed passageway turn 220 cast by one of the feedcore spanwise portions 92, 102, 112.

The RMC apertures and associated slot walls and posts may be engineered by conventional techniques of computer modeling or iterative prototyping. In an exemplary reengineering situation, the resulting slot may offer reduced heat loading associated with blade tip vortices than in the baseline airfoil (e.g., having a conventional tip flag arrangement).

Figure 9:
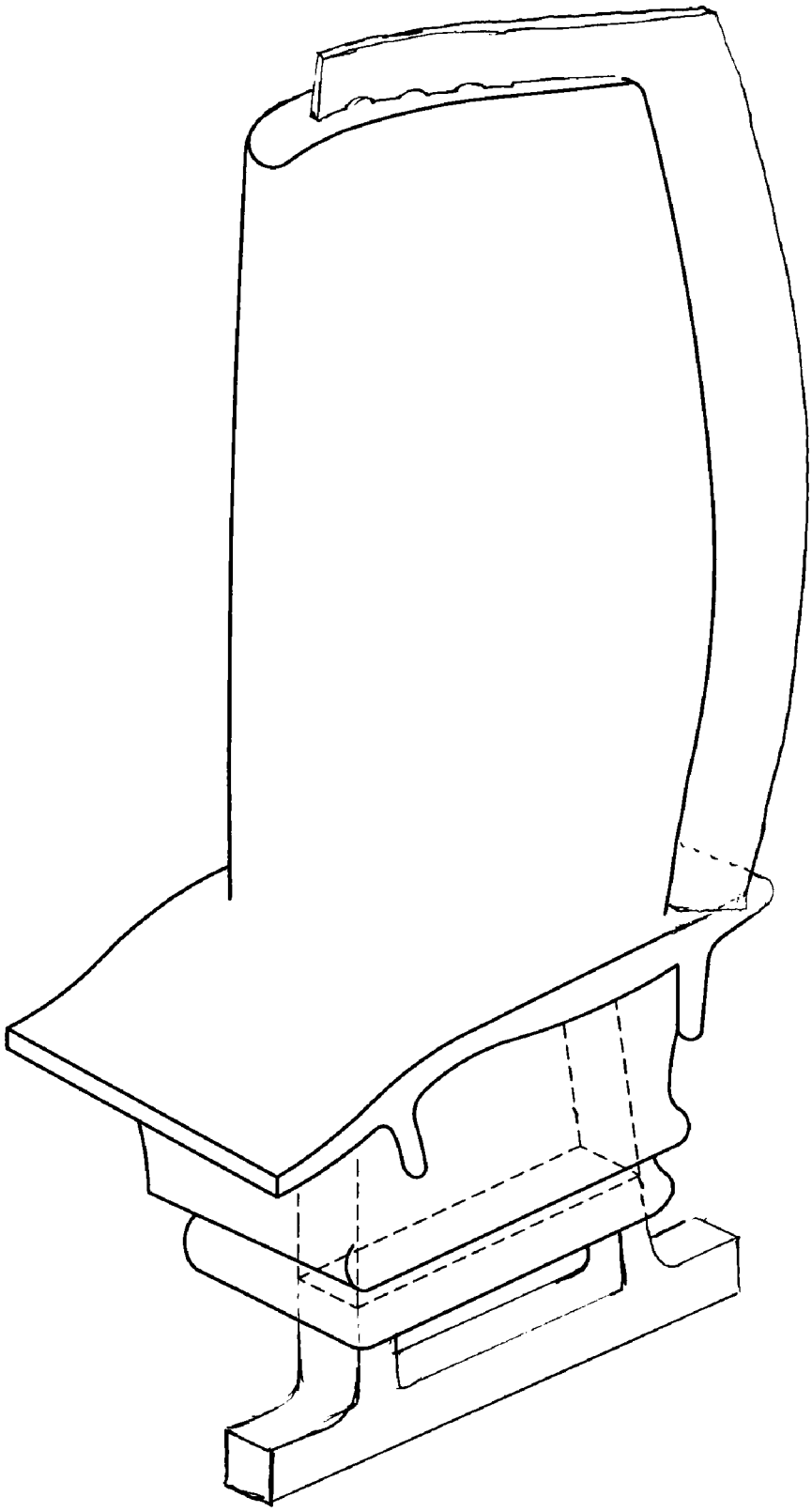
FIG. 9 is a view of a pattern.
Figure 10:
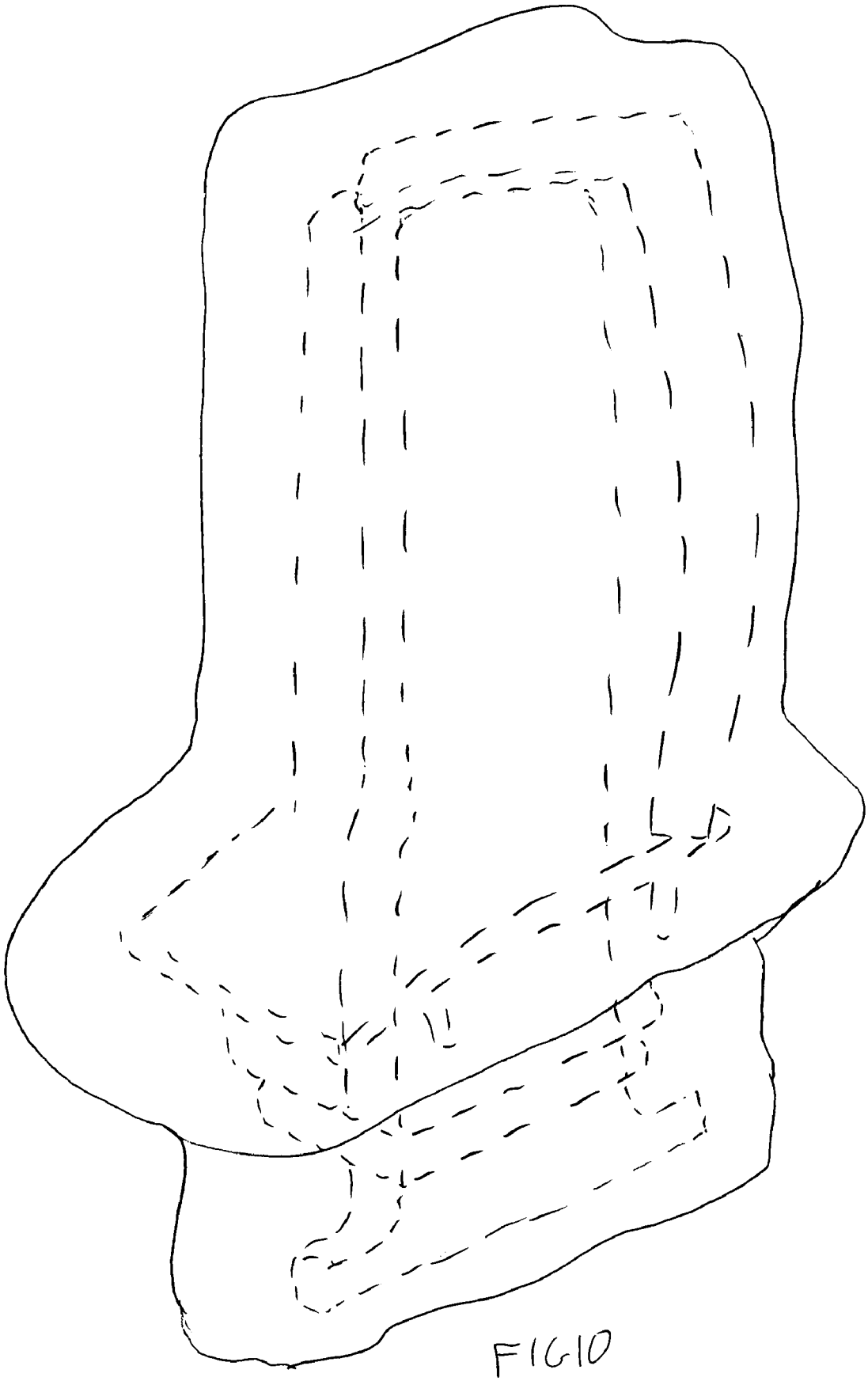
FIG. 10 is a view of a shell.

FIG. 9 shows a pattern formed over such a core assembly. FIG. 10 shows a shell formed by shelling such a pattern and removing the pattern wax in a dewax process.

One or more embodiments of the present invention have been described. Nevertheless, it will be understood that various modifications may be made without departing from the spirit and scope of the invention. For example, the invention may be implemented in the context of various existing or yet-developed casting technologies and core manufacturing technologies. The principles may be implemented in the manufacturing of a variety of blades including reengineerings of existing blade configurations. In such situations, details of the technologies, applications, and configurations may influence or dictate details of any particular implementation. Accordingly, other embodiments are within the scope of the following claims.

What is claimed is:

1. An article comprising:

a blade casting core combination comprising:

a ceramic feedcore having:

a root end;

a tip end;

a leading end;

a trailing end;

a first side;

a second side; and a plurality of legs extending between the root and tip ends and arrayed between the leading and trailing ends; and a monolithic metallic core having:

a first face;

a second face;

a first portion extending from the feedcore trailing end; and a second portion extending from the tip end.

2. The article of claim 1 wherein:

the metallic core comprises substrate comprising at least 50% by weight one or more refractory metals.

3. The article of claim 1 wherein:

the metallic core has essentially constant thickness.

4. The article of claim 1 further comprising:

a wax body over portions of the metallic core and feedcore and comprising:

a platform portion;

an airfoil portion having;

a leading edge;

trailing edge;

a pressure side;

a suction side;

a tip; and a proximal end at the platform portion; and a root portion depending from the platform portion opposite the airfoil portion, wherein:

the metallic core first portion includes:

a main portion embedded in the wax body; and a perimeter portion protruding from the wax body at the airfoil trailing edge; and the metallic core second portion includes:

a main portion embedded in the wax body; and a perimeter portion protruding from the wax body at the airfoil tip.

5. The article of claim 1 further comprising:

a shell over portions of the metallic core and feedcore and having a cavity comprising:

a platform portion;

an airfoil portion having;

a leading edge;

trailing edge;

a pressure side;

a suction side;

a tip; and a proximal end at the platform portion; and a root portion depending from the platform portion opposite the airfoil portion, wherein:

the metallic core first portion includes:

a main portion exposed within the cavity; and a perimeter portion embedded in the shell at the airfoil trailing edge; and the metallic core second portion includes:

a main portion exposed within the cavity; and a perimeter portion embedded in the shell at the airfoil tip.

6. A blade casting core assembly comprising:

a ceramic feedcore having:

a root end;

a tip end;

a leading end;

a trailing end;

a first side;

a second side; and a monolithic metallic core having an L-shaped planform with:

a leg at least partially along the feedcore trailing end; and a foot at least partially along the feedcore tip end.

7. The assembly of claim 6 wherein:

the metallic core comprises substrate comprising at least 50% by weight one or more refractory metals.

8. The assembly of claim 6 wherein:

the metallic core has essentially constant thickness.

9. The assembly of claim 6 wherein:

a leading portion of the leg is at least partially embedded in the feedcore; and an inboard portion of the foot is at least partially embedded in the feedcore.

* * * * *